US008505529B2

(12) United States Patent
King

(10) Patent No.: US 8,505,529 B2
(45) Date of Patent: Aug. 13, 2013

(54) ALTERNATE INTAKE APPARATUS

(76) Inventor: Jerry J. King, Kokomo, IN (US)

( * ) Notice: Subject to any disclaimer, the term of this patent is extended or adjusted under 35 U.S.C. 154(b) by 878 days.

(21) Appl. No.: 12/657,325

(22) Filed: Jan. 19, 2010

(65) Prior Publication Data

US 2010/0212651 A1 Aug. 26, 2010

Related U.S. Application Data

(60) Provisional application No. 61/208,536, filed on Feb. 25, 2009.

(51) Int. Cl.
*F23L 3/00* (2006.01)
*F24H 1/00* (2006.01)

(52) U.S. Cl.
USPC ..... 126/112; 126/292; 126/293; 126/295; 126/285 R; 126/344; 454/234; 236/45

(58) Field of Classification Search
USPC ..... 126/112, 342, 344, 285 R, 135.1; 454/322; 236/45
See application file for complete search history.

(56) References Cited

U.S. PATENT DOCUMENTS

| | | | | |
|---|---|---|---|---|
| 4,146,048 | A * | 3/1979 | McCabe | 137/75 |
| 4,161,941 | A | 7/1979 | Bloxham | |
| 4,329,967 | A * | 5/1982 | Levenberg | 126/293 |
| 4,353,349 | A | 10/1982 | Bormida, Jr. | |
| 4,421,096 | A * | 12/1983 | Butzen | 126/285 B |
| 4,480,558 | A | 11/1984 | Russell | |
| 4,699,121 | A * | 10/1987 | Apollonia | 126/292 |
| 5,911,217 | A * | 6/1999 | Dameworth et al. | 126/344 |
| 7,967,669 | B2 * | 6/2011 | Baik | 454/234 |
| 2012/0282853 | A1 * | 11/2012 | Sinur et al. | 454/238 |

* cited by examiner

*Primary Examiner* — Kang Hu
*Assistant Examiner* — Nikhil Mashruwala
(74) *Attorney, Agent, or Firm* — Frank D. Lachenmaier

(57) ABSTRACT

The present invention relates generally to 90% Annual Fuel Utilization Efficiency gas or oil burning devices that depend on external air for combustion. More particularly it discloses an alternate intake apparatus for air for combustion that opens automatically when the inlet air conduit from outside is blocked or severely restricted.

3 Claims, 6 Drawing Sheets

ALTERNATE INTAKE APPARATUS

BACKGROUND

1. Field of Invention

The present invention relates generally to 90% Annual Fuel Utilization Efficiency (AFUE) gas furnaces and water heaters. 90% AFUE devices bring combustible air into the device from outside the structure being heated through an outside air conduit with a screen cap on the outside end. When outside temperatures drop below 10 degrees Fahrenheit, the inlet air screens tend to freeze or get covered in snow. More particularly it discloses an alternate intake apparatus that is installed on the outside air conduit that opens automatically to a second source of combustible air inside the heated structure when the inlet air screen from outside is blocked or frozen.

2. Prior Art

90% AFUE gas furnaces have a combustible air inlet conduit that runs from outside the building to the combustion chamber of the furnace or water heater. Typically they have a screen cap over the inlet end to prevent entrance of pests into the conduit. The inlet screen of this conduit tends to freeze-up or become blocked with snow and ice when the outside temperature falls below 10 degrees Fahrenheit. Prior art attempts to resolve this problem include numerous expensive service calls to knock the ice off the conduit screen or even worse, calls to repair extensive damage from frozen water lines in an unattended home. To date the prior art attempts to resolve this problem have been ineffective and costly.

SUMMARY OF THE INVENTION

The present Invention is an apparatus that mounts on the outside air conduit that provides an alternative source of air for combustion when the outside air conduit is blocked and the gas or oil burning device is trying to draw combustible air. It opens a normally closed unbalanced pivot plate to inside air when outside air conduit head pressure decreases because of the failed attempt to draw outside air. The unbalanced pivot plate automatically closes, returning the system to maximum efficiency, when the outside conduit opening thaws or the blockage is removed and the outside air again is flowing freely. The cost and time of a service call or the costs of repairing frozen pipes in an unattended house damaged when the furnace shuts down in very cold weather are thus saved.

DRAWINGS

In order that the invention is fully understood it will now be described with reference to the following drawings in which.

Figure 1A:
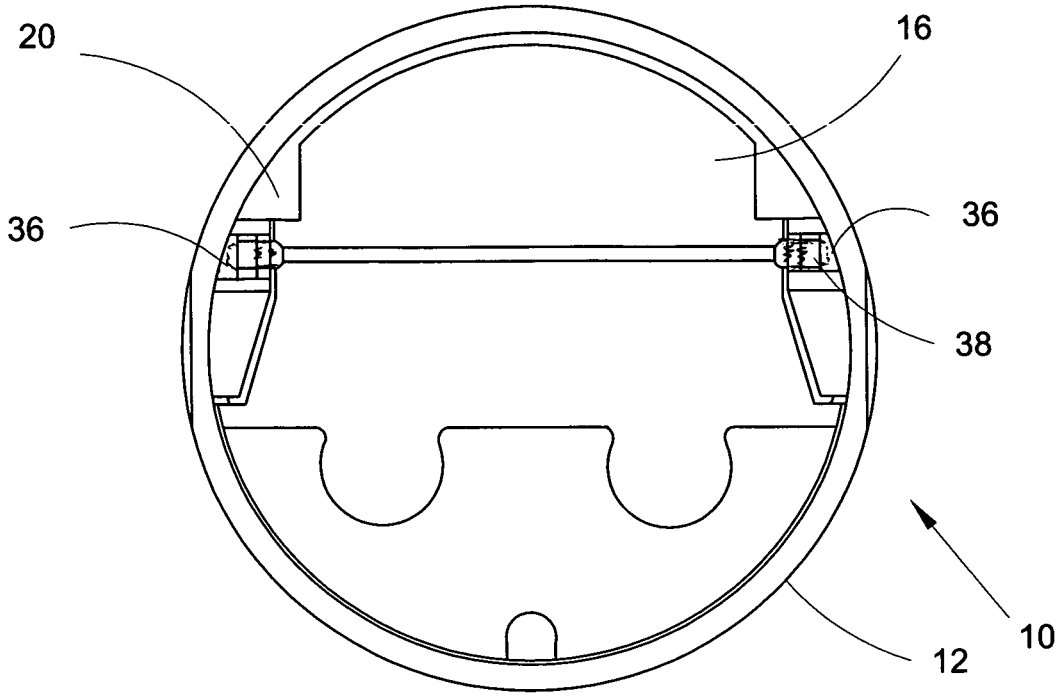
FIG. 1A is a top view of alternate intake apparatus in its normally closed position.
Figure 1B:
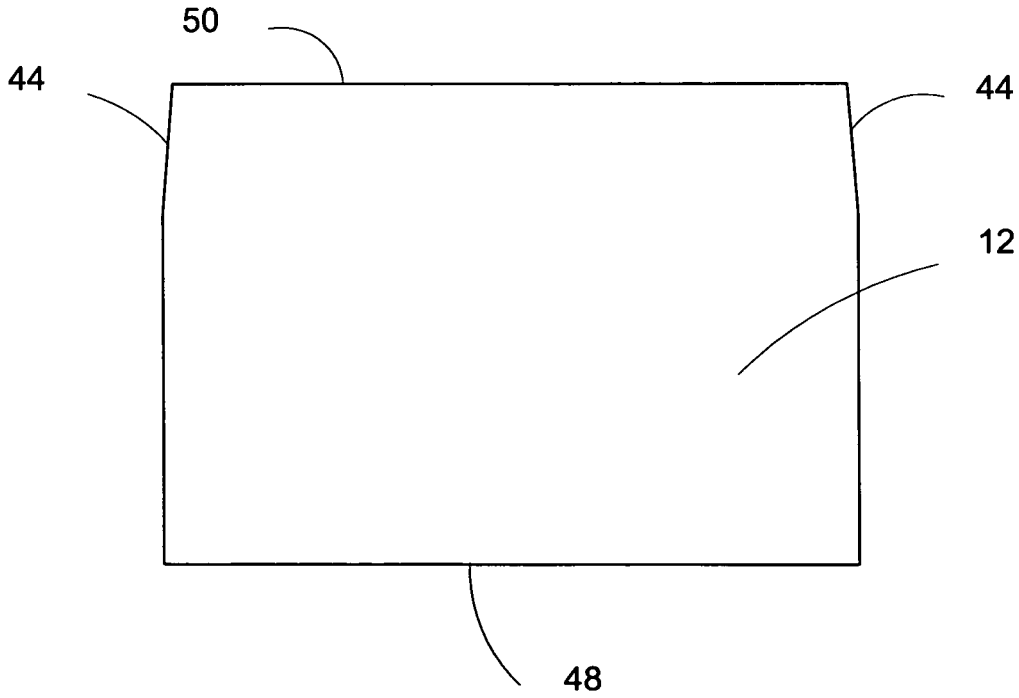
FIG. 1B is a front view.

Building, gas or oil burning device, inlet air conduit, exhaust line and screen shown in broken lines as they are not part of this invention but shown for illustrative purposes only.

REFERENCE NUMBERS

The same reference numbers will be used throughout this application for the same and like features.

DESCRIPTION

In order that alternate intake apparatus 10 is fully understood it will now be described by way of the following example. This new invention is a convenient and easily adaptable apparatus for use as a part of an initial 90% AFUE gas furnace or water heater 30 installation. It also can be used as a simple addition to any gas or oil-burning system utilizing outside air conduit 26 to convey combustible air 32 to burner. Alternate intake apparatus 10 spliced into outside air conduit 26 inside the home, as shown in FIGS. 6-9A, opens due to the drop in head pressure in outside air conduit 26 when inlet air screen 46 is blocked by ice, snow or any other reason. Alternate intake apparatus 10 allows furnace or heater 30 to continue to function as it opens and allows furnace or heater 30 to pull its combustible air 22 from basement 24 through an opened alternate intake apparatus 10 until the external blockage is removed.

FIGS. 1-5 describe a preferred embodiment of alternate intake apparatus 10 in which cylindrical tubular base 12 is a 3¼ inch inside diameter cylindrical tube, approximately 2½ inches long and has approximately a ⅛ inch wall thickness. Pivot retaining means 36 are formed on the inside wall of cylindrical tubular base 12 at each end of a chord approximately ⅝ of an inch radially outward from cylindrical tube axis and approximately ½ inch axially above bottom face 48. Upper rear stop 20 begins above and axially behind pivot retaining means 36 on the left side, extending radially inward from inside wall and arches over to the over to the top of and axially behind pivot retaining means 36 on the right side. The inside radius of upper rear stop 20 is a sufficient amount, approximately ⅛ of an inch, smaller than the outside radius of pivot plate 16 to act as a stop when pivot plate 16 is in its normally closed position. Lower front stop 14 begins below and axially in front of pivot retaining means 36 on the left side, extending radially inward from inside wall and arches under to the to the bottom of and axially in front of pivot retaining means 36 on the right side. The inside radius of lower front stop 14 is a sufficient amount, approximately ⅛ of an inch, smaller than the outside radius of pivot plate 16 to act as a stop when pivot plate 16 is in its normally closed position. Lower front stop 14, pivot retaining means 36 and upper rear stop 20 lean axially toward bottom face 48 where the shorter section, approximately ⅝ inch above pivot pins 38 is rotated upward against upper rear stop 20 and the longer heavier section below pivot pins 38 is rotated downward against lower front stop 14, supplementing the unbalanced forces caused by the different thicknesses of the upper and lower sections of pivot plate 16 and its off center pivot point. Pivot plate 16 is dimensioned such that the upper section can be slipped between upper and lower stops 14 and 20 while pivot pins 38 are slid along pivot pin guide ramp 52 from top face 50 between top and bottom guide rails 40 and 42 until it snaps over pivot pin back stop 54. Pivot pin 38 is thus restrained axially by pivot pin front stop 56 and back stop 54 and radially by top and bottom guide rails 40 and 42.

Figure 2:
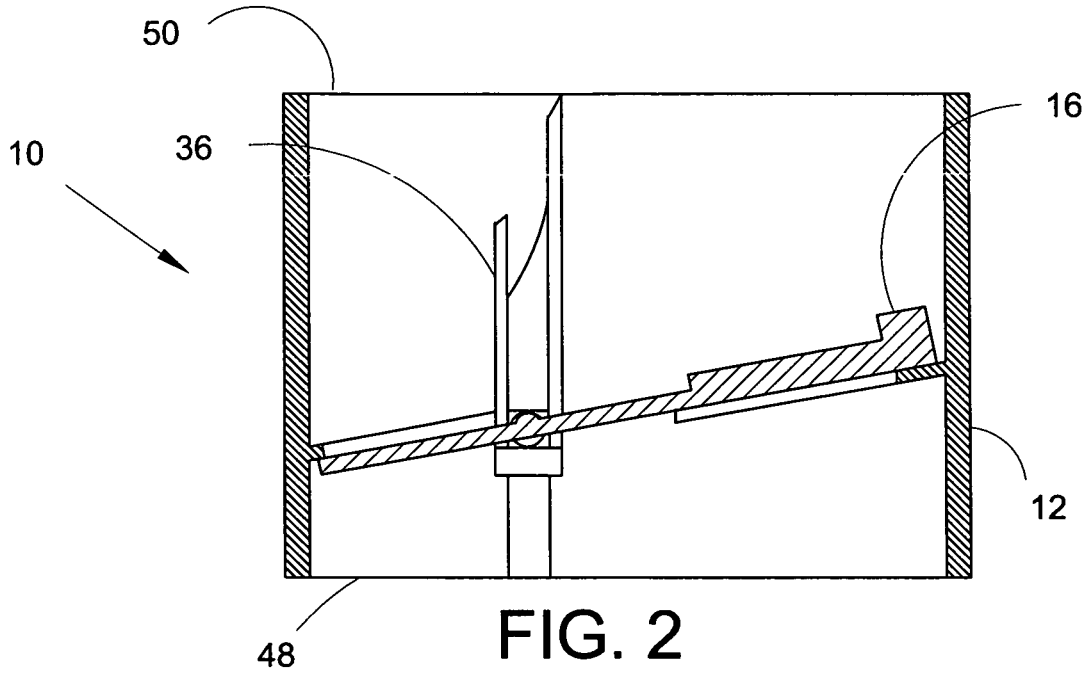
FIG. 2 is a section view taken on cutting plane 2-2 in FIG. 1C in its closed position.
Figure 2A:
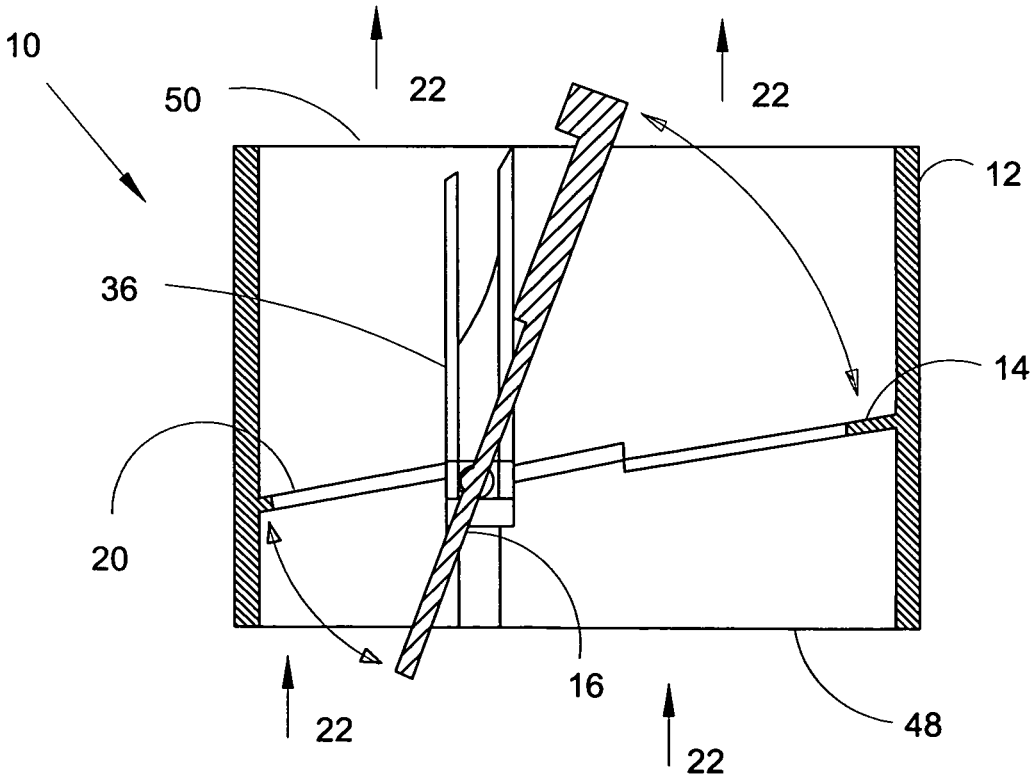
FIG. 2A is a section view taken on cutting plane 2-2 in FIG. 1C in its open position.
Figure 3:
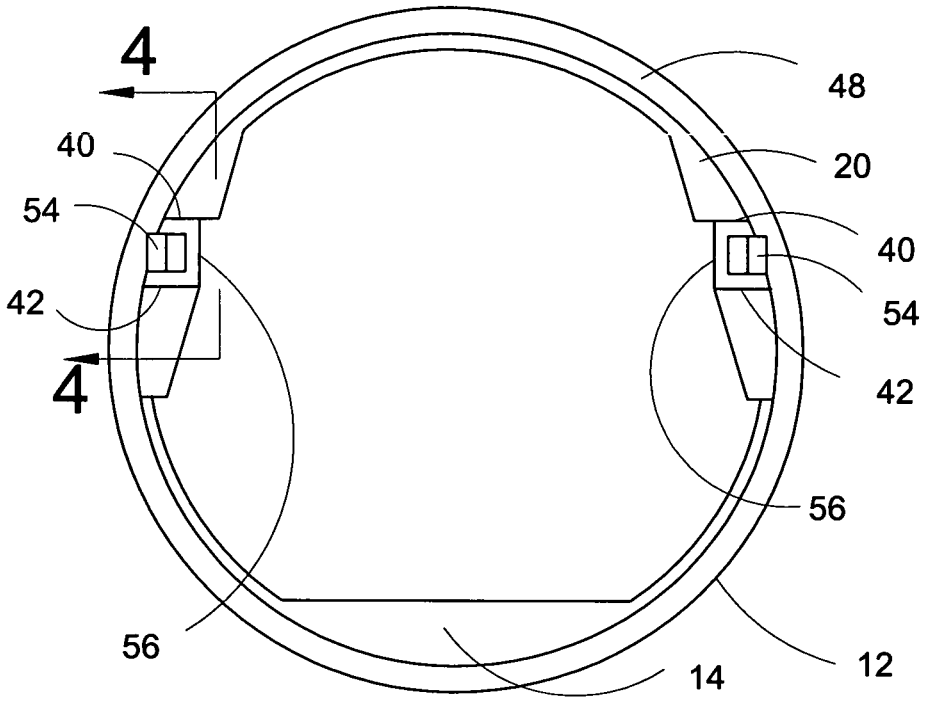
FIG. 3 is a bottom view of cylindrical tube base.
Figure 4:
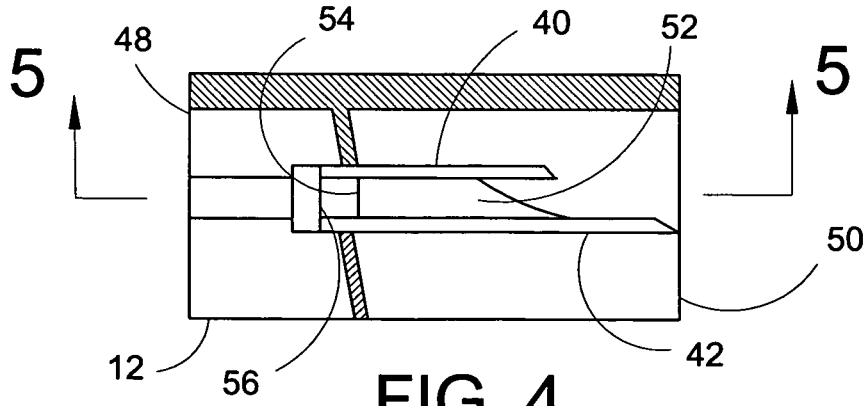
FIG. 4 is a partial section view taken along cutting plane 4-4 in FIG. 3.
Figure 5:
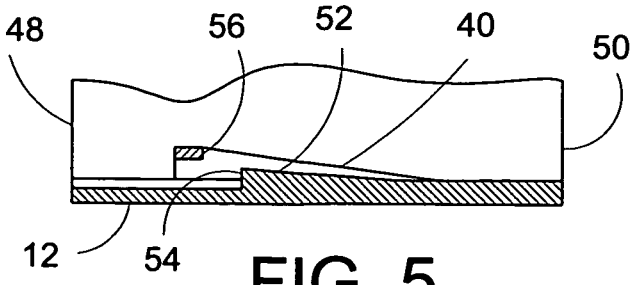
FIG. 5 is a partial section view taken along cutting plane 5-5 in FIG. 4.

Pivot plate 16 is pivotally mounted in the 3¼ inch diameter cylindrical tubular base 12 with a downward leaning upper rear stop 20 and lower front stop 14. Pivot pins 38 are on the right and left sides of pivot plate 16 at matching points to pivot retaining means 36. Pivot plate 16 has a larger mass of material below its pivot pins 38 than the mass above pivot pins 38. This combined with the forward leaning stops 20 and 14 allows gravity to pull pivot plate 16 against stops 14 and 20 when alternate Intake apparatus 10 is positioned properly as shown in FIG. 2 and inlet air screen 46 is clear and outside combustible air 32 is flowing. Relative masses of top and bottom sections of pivot plate 16 are chosen in such a manner as to eliminate pivot plate 16 flutter during normal operation. Relative masses are also balanced such that the decrease in line head pressure caused by blocking air inlet screen 46 while gas burning device 30 is trying unsuccessfully to draw outside air for combustion 32 causes pivot plate 16 to rotate about pivot pins 38. Pivot plate 16 rotates until bottom guide rails 42 of pivot retaining means 36 block further rotation of back edge of pivot plate 16 as shown in FIG. 2A. This rotated position of pivot plate 16 then allows ambient inside air 22 to be drawn through alternate intake apparatus 10, preventing system shut down.

Figure 1C:
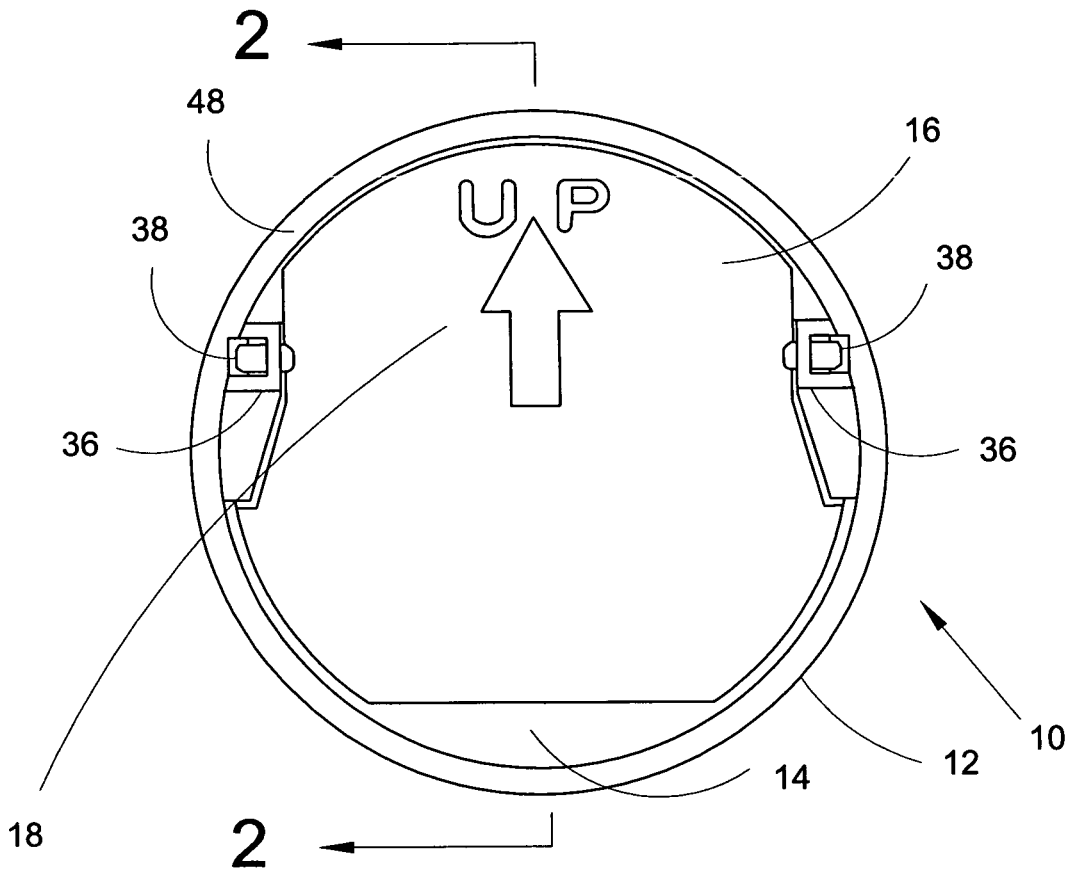
FIG. 1C is a bottom view.
Figure 1D:
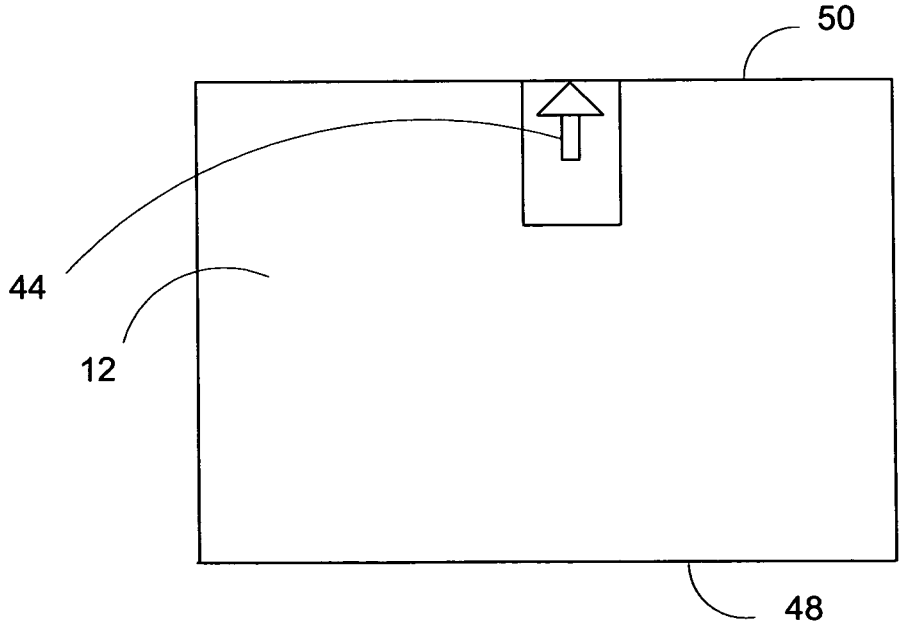
FIG. 1D is a right side view where the left side is a mirror image of right side.

FIG. 1C shows UP indicia 18 for 45 degree to horizontal applications. FIG. 1D shows a side view of alternate intake apparatus 10 with installation guidance indicator arrows 44 on the sides pointing toward rear face 50 showing the direction of assembly required for a functioning installation.

OPERATION

Furnaces and water heaters that draw air from the outside for combustion 32 typically draw the air through an inlet air screen 46 over the outside end of an outside air conduit 26 into a gas or oil burning device 30. Exhaust gases are typically vented to the outside though an exhaust line 34. Furnaces and water heaters 30 are often located in a basement, attic, crawl space or some other heated area 24 within building 28. It is not uncommon for inlet air screens 46 to freeze or become blocked with blowing or drifting snow in areas where outside temperatures fall below 10 degrees Fahrenheit. When this blockage occurs and the heating unit attempts to draw air for combustion and it fails, an automatic triggering of a safety shutdown sequence occurs resulting in nuisance service calls to have the blockage removed and the heating device restarted or in the case of an unattended home, severe damage from broken pipes.

Figure 6:
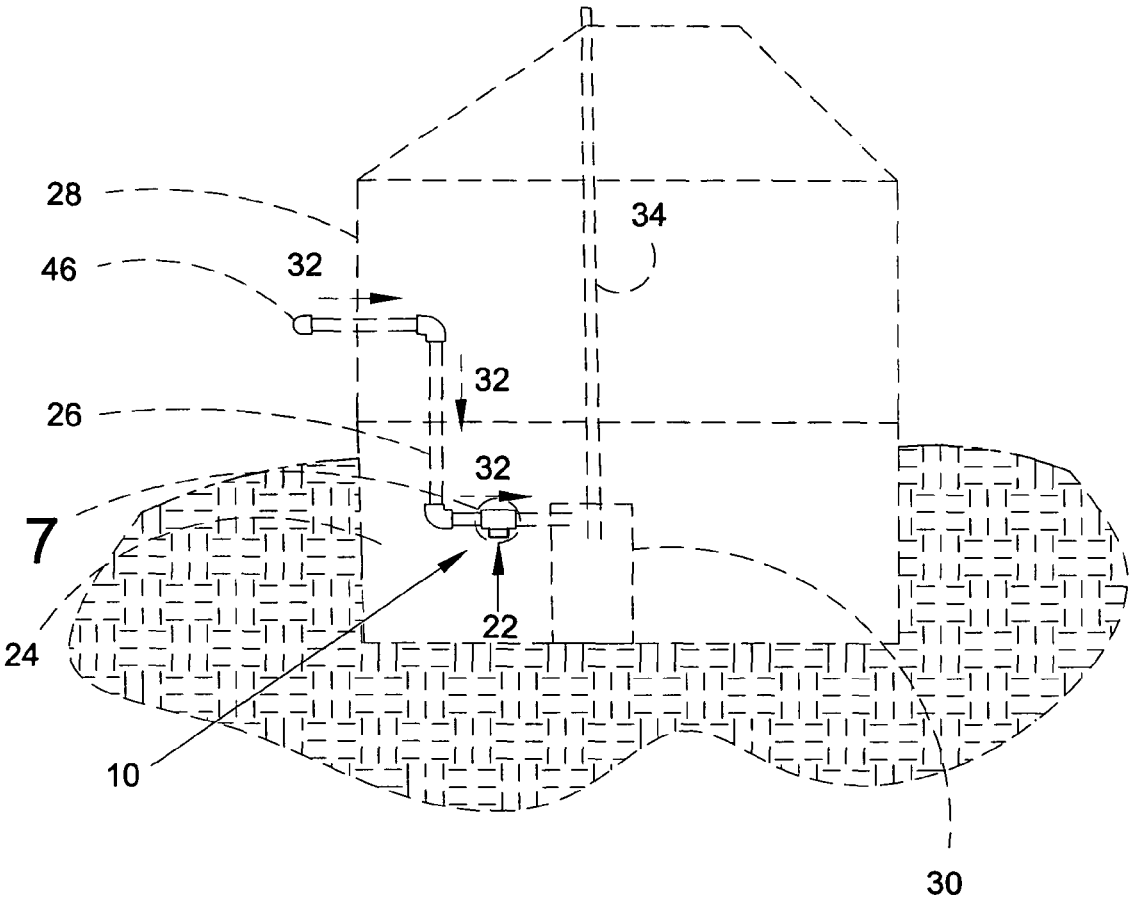
FIG. 6 is a block diagram of a 90% AFUE furnace or water heater installation in the basement of a building with an alternate intake apparatus mounted on a T fitting spliced into a horizontal inlet air conduit inside the basement.
Figure 7:
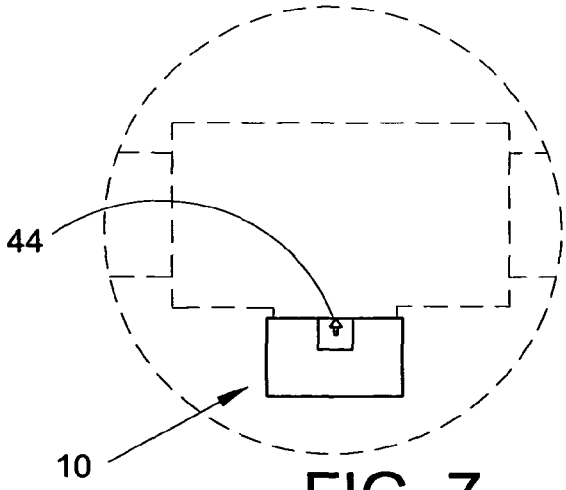
FIG. 7 is an enlarged partial view of an alternate intake apparatus mounted on a T fitting.
Figure 8:
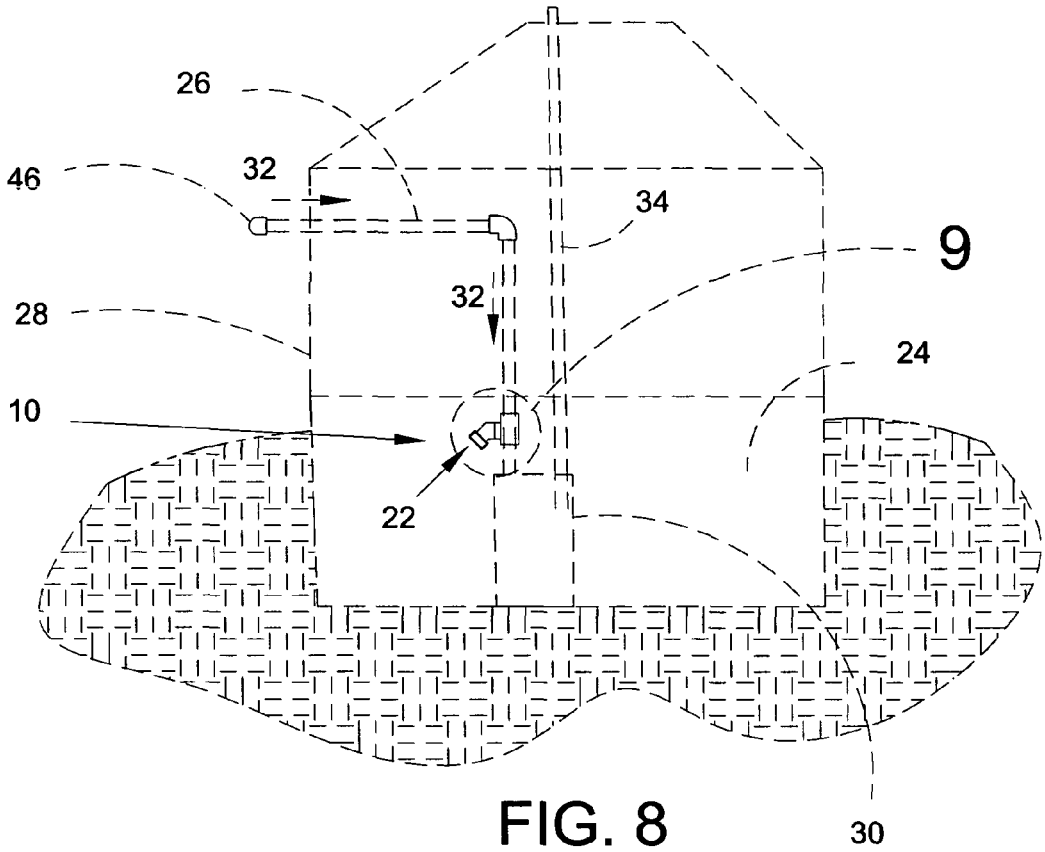
FIG. 8 is a block diagram of a 90% AFUE furnace or water heater installation in the basement of a building with an alternate intake device mounted on a downward angled T fitting spliced into a vertical inlet air conduit inside the basement.
Figure 9:
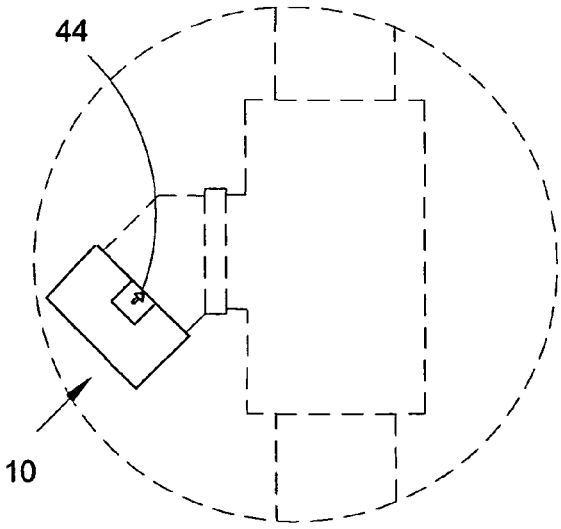
FIG. 9 is an enlarged partial view of an alternate intake apparatus mounted on a downward angled T fitting.
Figure 9A:
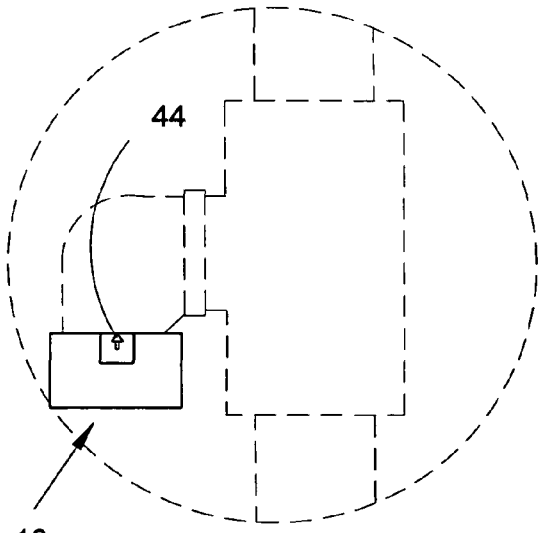
FIG. 9A is an enlarged partial view of an alternate intake apparatus mounted on a downward mounted elbow attached to a T fitting installed in a vertical air conduit.

Alternate intake apparatus 10 can be utilized either in a horizontal or in a vertical combustible air conduit 26 into a gas or oil burning device 30. FIGS. 6 and 7 show a horizontal installation where a standard plastic T is spliced into a horizontal air input line in an accessible location within the heated structure where sufficient quantities of combustible air are available to allow the device to continue operating with the depending member of the T fitting pointing downward. Alternate intake apparatus 10 is then installed over depending member of plastic T with installation indicia arrows 44 pointing up. FIGS. 8, 9 show a vertical air feed line installation with an angled plastic T with the protruding member angling downward spliced into the vertical line and alternate intake apparatus 10 installed over depending member of plastic T with installation indicia arrows 44 pointing on an upward angle. On angled installations such as this, it is also important that UP indicia 18 on pivot plate 16 are also pointing in an upward angle. For elbow mounted installations as shown in FIG. 9A the direction of indicia 18 is not important as long as the elbow itself is opening in a downward attitude.

The descriptions in the above specification are not intended to limit this invention to the 3 inch conduit application or the materials disclosed here. Rather, they are shown for illustration purposes only as one skilled in these arts could easily scale the invention's dimensions and materials to work with any size conduit feeding combustible air from outside to a furnace or water heater.

What is claimed:

1. A normally closed alternate intake apparatus that opens to provide combustible air from inside a heated space for 90% Annual Fuel Utilization Efficiency (AFUE) gas or oil burning furnaces or water heaters when outside combustible air conduit is blocked by snow or ice where said outside combustible air conduit enters said gas or oil burning device in a horizontal or a vertical attitude comprised of:

a cylindrical tubular base with an inside diameter, an outside diameter, a bottom face, a top face, a front side, a left side, an inside wall, an outside wall, an axis and a length;

pivot retaining means on said right and left sides of said inside wall of said cylindrical tubular base at each end of a chord that is approximately ⅙ of said inside diameter radially outward from said cylindrical tubular base axis;

an upper rear stop that has a front surface that extends radially inward from said inside wall, and angled towards the bottom face radially above and axially closer to said bottom face than said pivot retaining means;

a lower front stop surface that has a rear surface that extends radially inward and angled towards the top face from said inside wall radially below and axially further away from said bottom face than said pivot retaining means wherein the said upper stop is longer than the said lower stop;

a pivot plate with a top, a bottom, a right side, a left side, a front side, a back side, a top section and a bottom section with pivot pins on said right and left sides that fit into said pivot retaining means on said inside wall of said cylindrical tubular base and are located at points approximately ⅔ the distance between said top and bottom from said bottom, where said pivot pins have a diameter and a length and where said top section is thinner than said bottom section and the ratio of masses between said top section and said bottom section is selected as to provide sufficient pressure by said pivot plate top upward against said upper front stop and said pivot plate bottom downward against said lower rear stop as to keep said pivot plate closed during normal operation, when said alternate intake apparatus is mounted either over the depending end of a plastic T fitting spliced into a horizontal section of said outside air inlet conduit with said top face oriented upward, the depending end of a downward angled T fitting spliced into a vertical section of said outside air inlet conduit with said top face oriented upward or the depending end of a downward facing elbow fitting attached to the horizontal section of a T fitting spliced into a vertical section of said outside air inlet conduit with said top face oriented upward; where said pivot plate's exterior dimensions clear said inside diameter of said cylindrical tubular base and said pivot retaining means, but are larger than the inside diameters of said upper rear stop and said lower front stop;

said pivot plates said front side has the word UP and an arrow pointing upward at said top;

said bottom section of said pivot plate beneath said pivot retaining means is thicker than the section above said pivot retaining means a sufficient amount as to provide a downward force of sufficient magnitude as to hold said alternate air intake apparatus closed during normal operation but small enough as to allow the decreased head pressure in said outside air conduit to pivot said pivot plate away from said upper and lower stops allowing a flow of internal ambient air into said burning chambers and allowing said 90% AFUE gas or oil burning furnaces or water heaters to continue operation even after input air line is blocked with snow or ice.

2. A normally closed alternate intake apparatus as in claim 1 further comprising installation indicia on said outside walls of said cylindrical tubular base.

3. A normally closed alternate intake apparatus as in claim 1 wherein said pivot retaining means comprise:

a bottom guide rail that begins at said top face, flush with said inside wall and increases in height radially inward as it moves axially toward said bottom face to a predetermined apex;

a top guide rail that is vertically separated from said bottom rail and parallel to it by a clearance dimension to said diameter of said pivot pin where said top surfaces of said guide rails are parallel and reach said predetermined height at the same apex;

said top and bottom guide rails continue on axially toward said bottom face at this height for a predetermined distance;

a pivot pin guide ramp that begins between said top and bottom guide rails and increases radially in height to approximately half of the said predetermined height of said guide rails when it reaches the apex of said guide rails, where it falls back radially to a flat surface that begins at the top of said bottom rail and rises vertically into inside wall to the bottom side of said top rail;

a pivot pin front stop is formed by the upper edge of a connecting bridge between said tops of said guide rails where said connecting bridge is of sufficient length axially back from said predetermined length as to provide a pivot pin diameter clearance opening between said back edge of said pivot pin front stop and said pivot pin back stop comprised of said falling face of said pivot pin guide ramp wherein said pivot pins on said pivot plate are shoved down said ramp between said rails until its snaps over said end of said ramp and falls into said pocket s formed by said pivot pin front stop, said pivot pin rear stop, said pivot bottom guide rail and said top guide rail where the distance between the ends of said pivot pins is slightly larger than the distance between the apexes of said right and left pivot pin guide ramps.

* * * * *